US006315107B1

(12) United States Patent
Müller et al.

(10) Patent No.: US 6,315,107 B1
(45) Date of Patent: Nov. 13, 2001

(54) CONVEYOR PLANT FOR GATHERING AND PROCESSING PRINTED SHEETS

(75) Inventors: Hans Müller, Zofingen; Peter Merkli, Oftringen, both of (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/082,882

(22) Filed: May 21, 1998

(30) Foreign Application Priority Data

May 29, 1997 (CH) ..... 1266/97

(51) Int. Cl.[7] ..... B65G 15/24

(52) U.S. Cl. ..... 198/606; 198/644; 271/198; 414/790.3; 270/52.29

(58) Field of Search ..... 198/606, 607, 198/644; 414/790.3; 270/52.29, 58.29; 271/184, 233, 140, 139, 141, 131, 198

(56) References Cited

U.S. PATENT DOCUMENTS

| | | | | |
|---|---|---|---|---|
| 1,083,617 | * | 1/1914 | Kast | 270/52.29 |
| 1,986,857 | * | 1/1935 | Roberts et al. | 271/233 |
| 2,547,964 | * | 4/1951 | Nordquist et al. | 271/233 |
| 3,675,792 | * | 7/1972 | Griner et al. | 414/790.3 X |
| 3,738,514 | * | 6/1973 | Jones | 414/790.3 X |
| 4,541,764 | * | 9/1985 | Govan et al. | 414/790.3 X |
| 4,770,284 | * | 9/1988 | Boss | 198/644 X |
| 5,000,657 | * | 3/1991 | Gunther, Jr. | 414/790.3 |
| 5,476,361 | * | 12/1995 | Uno | 414/790.3 X |
| 5,899,453 | * | 5/1999 | Middelberg et al. | 271/184 |

FOREIGN PATENT DOCUMENTS

| | | | |
|---|---|---|---|
| 667253 | | 9/1988 | (CH) . |
| 0881180A1 | * | 5/1998 | (EP) . |
| 0976672A2 | * | 2/2000 | (EP) . |

* cited by examiner

*Primary Examiner*—Christopher P. Ellis
*Assistant Examiner*—Patrick Mackey
(74) *Attorney, Agent, or Firm*—Friedrich Kueffner

(57) ABSTRACT

A conveyor plant for gathering and processing printed sheets includes a saddle-shaped collecting chain, a double chain with a gap between the individual chains of the double chain, a transfer area in which the collecting chain travels into the gap of the double chain, and carrier members for the printed sheets arranged successively on the collecting chain. The carrier members are mounted on the collecting chain in an upright position. The carrier members of the collecting chain are inclined forwardly at least in the travel direction.

11 Claims, 3 Drawing Sheets

CONVEYOR PLANT FOR GATHERING AND PROCESSING PRINTED SHEETS

BACKGROUND OF THE INVENTION

1. Field of the Invention

The present invention relates to a conveyor plant for gathering and processing printed sheets. The plant includes a saddle-shaped collecting chain and a double chain, a transfer area in which the collecting chain travels into the double chain, and carrier members for the printed sheets arranged successively on the collecting chain. The present invention also relates to collecting chain, particularly for a conveyor plant of the above-described type.

2. Description of the Related Art

CH-A-667 253 of the same applicant discloses a conveyor plant for printed sheets which includes an auxiliary chain for bridging a gap between the end of a first conveyor chain portion and the beginning of a second conveyor chain portion. In this conveyor plant, the printed sheets can be processed laterally of the auxiliary chain from the inside as well as from the outside almost up to the fold. In particular, this conveyor plant makes it possible without significant problems to print with an ink-jet device up to the areas adjacent the fold.

Also known in the art is a conveyor plant with a collecting chain which has carrier members in the form of laterally projecting horns. The collecting chain is a single chain and, thus, has the advantage as compared to a double chain that no division or spacing differences can occur even over greater collecting distances. The collecting chain is inserted into a double chain in the transfer area. The printed products can be stitched on this double chain because the double chain has an intermediate space for the bending mechanism of the stitching device. This conveyor plant has the disadvantage that the double chain does not have an optimum structural configuration, particularly for smaller sizes.

SUMMARY OF THE INVENTION

Therefore, it is the primary object of the present invention to provide a conveyor plant of the above-described type which avoids the disadvantage described above and, while providing the same or a greater output, still is operationally safe and is suited for all sizes.

In accordance with the present invention, the carrier members are mounted on the collecting chain in an upright position.

The narrow structural configuration of the collecting chain which is now possible and the arrangement of the carrier members on the ridge of the collecting chain make it also possible to use a correspondingly narrow double chain which substantially facilitates grasping and processing of small printed sheets. In addition, a narrow collecting chain facilitates grasping of the printed sheets during gathering more closely near the fold.

The fact that the carrier members of the collecting chain are inserted between the double chain in the transfer area makes possible an optimum utilization of the spacing of the carrier members on the collecting chain; consequently, the spacing is not shortened by the fact that the carrier members pivot away when they are inserted or travel between the double chain.

Another advantage of the conveyor plant according to the present invention is seen in the fact that the printed sheets have to be opened to a lesser extent when being placed on the collecting chain, which is an advantage particularly in the case of high travel speeds.

It is also advantageous that the basic construction of the double chain does not have to be changed.

In accordance with a further development of the invention, the carrier members of the collecting chain are inclined forwardly at least in the travel direction. This particular configuration of the carrier members of the collecting chain has the advantage that the impact behavior and the acceleration of a printed sheet when being placed on the collecting chain is favorably influenced. While in the case of a conventional vertically extending carrier member a printed product to be placed on the chain may bounce upwardly and may jump away, the carrier member extending at an angle pushes the product back onto the collecting chain. Consequently, the printed product cannot jump over the carrier member, so that the carrier member can be constructed with a shorter length than is the case in a straight configuration of the carrier member.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
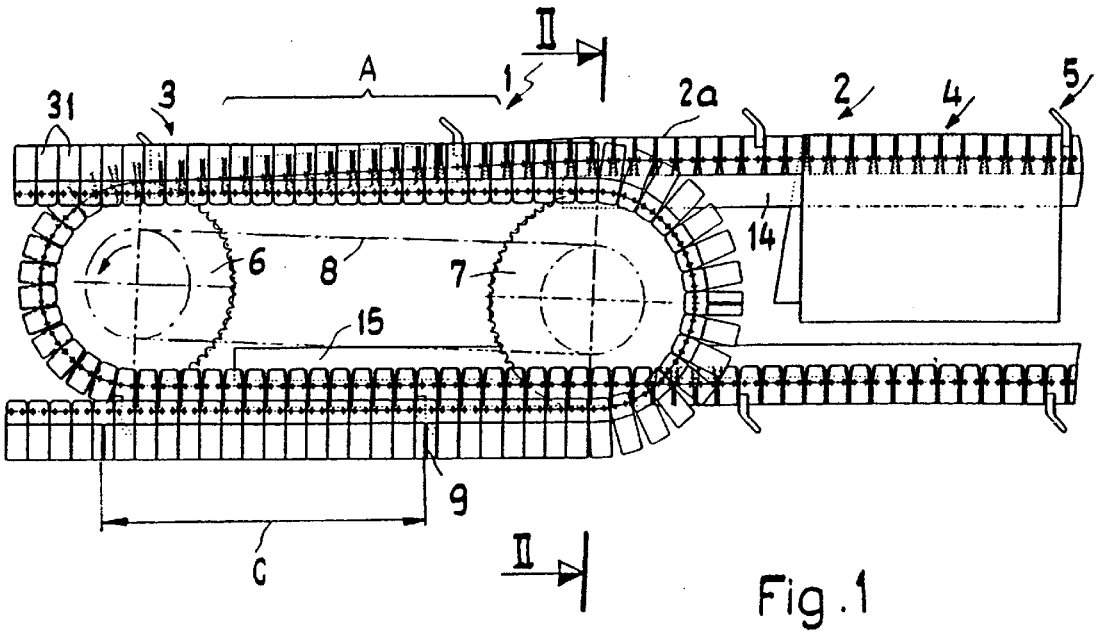
FIG. 1 is a schematic side view of the conveyor plant according to the present invention.

The conveyor plant 1 shown in FIG. 1 includes an endless collecting chain 2 and an also endless double chain 3. The collecting chain 2 serves in the conventional manner for gathering printed products 4 which are further processed on the double chain 3, for example, by stitching or applying addresses.

The collecting chain 2 is a link chain and travels around the chain wheel 6, while the double chain 3 travels around the chain wheel 7. The two chain wheels 6 and 7 are connected to each other through a transmission drive 8. The double chain 3 is preferably driven by means of a drive, not shown. Consequently, the collecting chain 2 is driven through the double chain 3.

Figure 2:
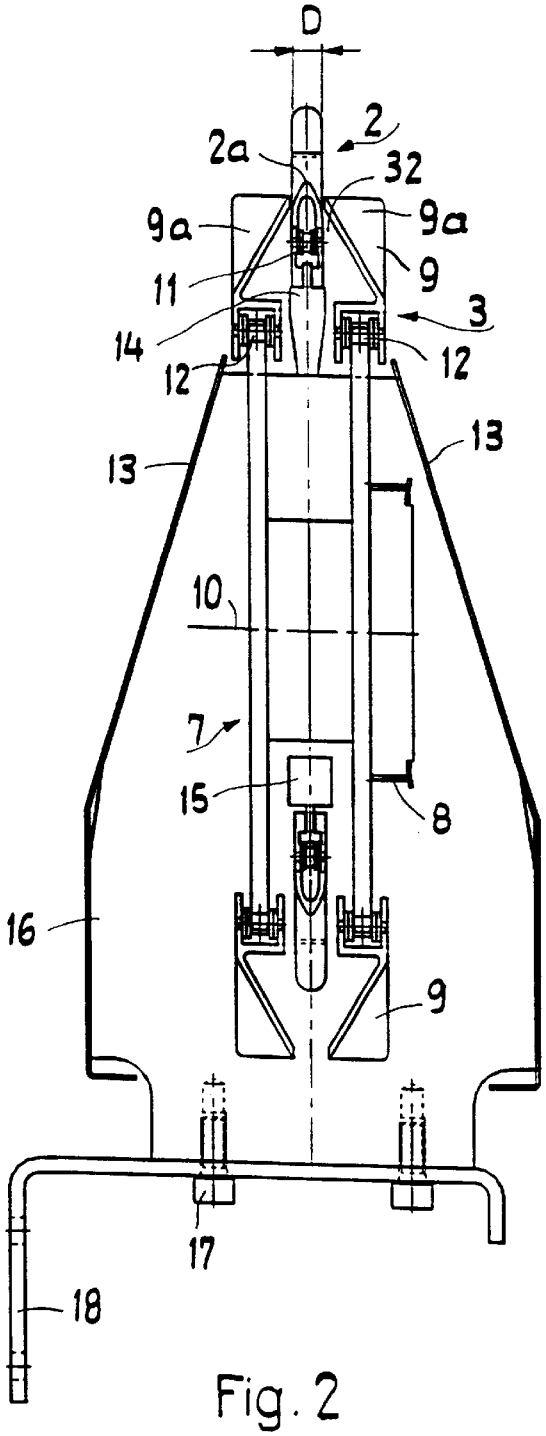
FIG. 2 is a sectional view, on a larger scale, taken along sectional line II—II of FIG. 1.

Carrier members 5 are mounted at equal distances B on the collecting chain 2. As can be seen in FIG. 1, the carrier members 5 protrude upwardly in the active portion 2*a* of the collecting chain 2. The double chain 3 also has at equal distances C carrier members 9 which, however, project laterally, as illustrated in FIG. 2. Each carrier member 9 is composed of two laterally projecting wings 9*a*.

The collecting chain 2 travels in a transfer area A between the double chain 3 and, following this area A, travels around the chain wheel 6. In front of the chain wheel 7, the collecting chain 2 is guided on a guide rail 14, and, following the chain wheel 6, the collecting chain is guided on a guide rail 15. Between the two chain wheels 6 and 7, the active portion 2*a* of the collecting chain 2 is inserted between the double chain 3. In the area of the chain wheel 7, the carrier members 5 protrude completely above the double chain 3, while they are completely or partially inserted or submerged in the double chain 3 in the area of the chain wheel 6. In the transfer area A, the printed products 4 are transferred to the double chain 3. For this purpose, the conveying speed of the double chain 3 is slightly greater than that of the collecting chain 2 and the distance C between adjacent carrier members 9 is somewhat greater than the distance D between adjacent carrier members 5. The greater conveying speed of the double chain 3 results from the smaller radius of the chain wheel 6 as compared to the radius of the chain wheel 7. Consequently, in the transfer area A, each printed product 4 is pushed away by a carrier member 9 of the double chain 3 in the conveying direction from an adjacent carrier member 5 of the collecting chain 2. As a result, downstream of the chain wheel 6, the printed products 4 are transported only by the double chain 3. The printed products 4 can then be stitched or further processed in some other manner on the double chain 3. The significant aspect is the fact that the carrier members 5 are swung downwardly on the chain wheel 6 once they have been completely or partially inserted in the double chain 3.

FIG. 2 of the drawing shows the chain wheel 7 which is mounted so as to be rotatable about an axis 10 and serves to guide and deflect the double chain 3. This double chain 3 has two link chains 12 which extend parallel to and at a distance form each other, wherein support elements 31 are fastened on the link chains 12, and wherein each support element 31 has a wing 9*a*. Two oppositely arranged wings 9*a* form a carrier member 9. A gap 32 exists between the two wings 9*a* of a carrier member 9 and also between the support elements 31, wherein the gap 32 has just such a width that the collecting chain 2 can travel into the gap 32. It is significant that the collecting chain 2 is relatively narrow and, thus, the width of the gap 32 is also relatively narrow. The width D of the collecting chain 2 is about 20 mm and is preferably narrower than 30 mm. As a result, the double chain 3 is also suitable for receiving relatively small-sized printed products.

Figure 8:
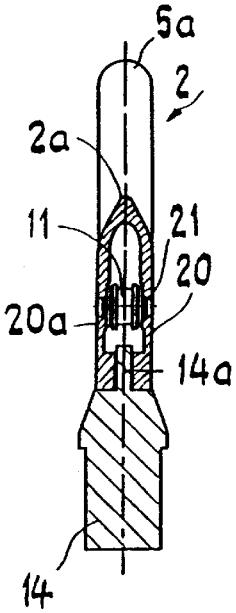
FIG. 8 is a cross-sectional view of a collecting chain.

The link chain 1 of the collecting chain 2 is a chain of the type of a bicycle chain and has laterally protruding bolts 21 to which elements 19 and 20 are fastened. The elements 19 and 20 preferably are U-shaped plastic parts which are provided with bores 22 for respectively receiving two bolts 21. As shown in FIG. 8, the two sides 20*a* of the elements 19 and 20 are guided in the area of the active portion 2*a* on a comb-type member 14*a* of the guide rail 14. The elements 20 differ from the elements 19 only by a carrier member 5 attached thereto. In the embodiment illustrated in FIG. 3, the carrier member 5 forms an angle and includes an upper part 5*b* and a top part 5*a*.

Figure 7:
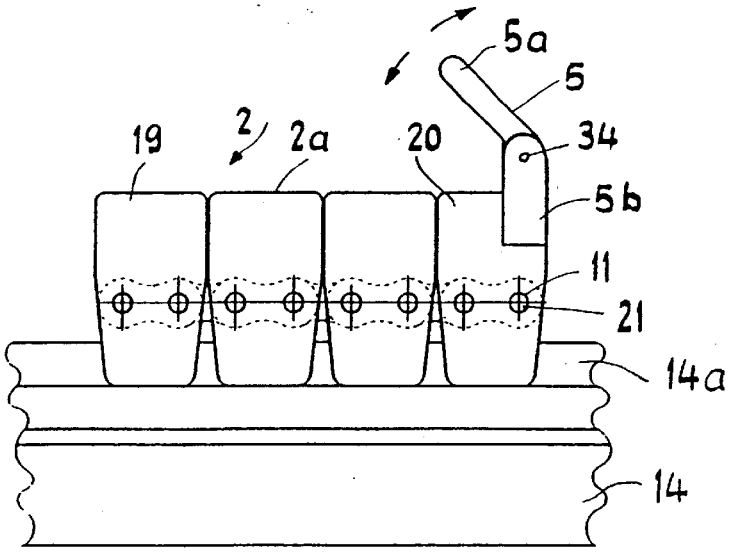
FIG. 7 is a partial view of the conveyor plant showing a further embodiment of the carrier member.
Figure 3:
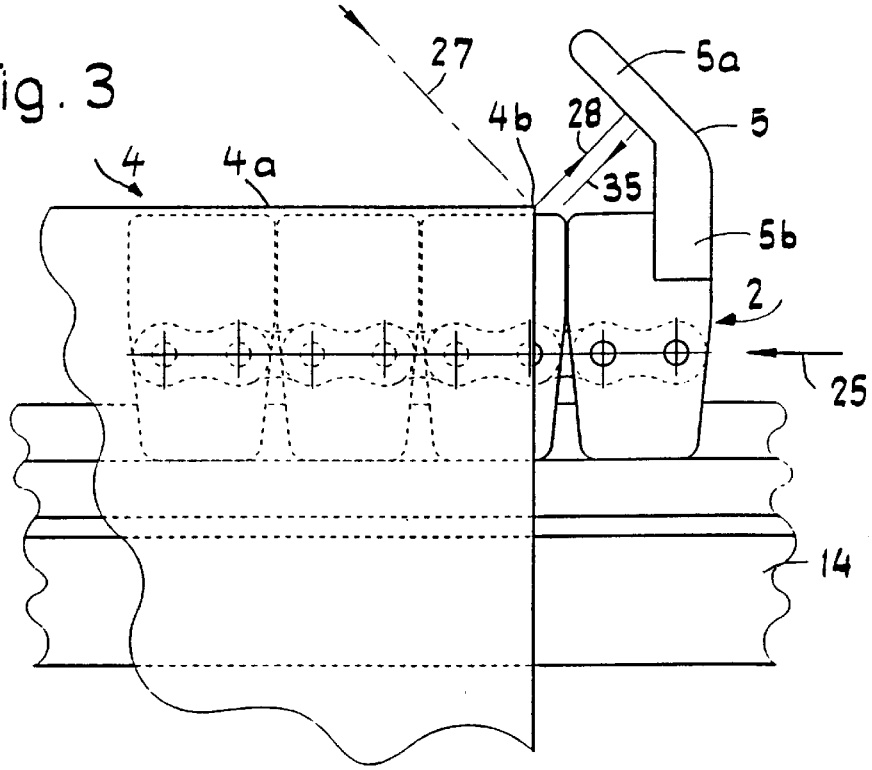
FIG. 3 is a partial view, on an even larger scale, of the conveyor plant according to the present invention.

In the active portion 2*a* shown in FIG. 3, the bottom part 5*b* extends vertically, while the top part 5*a* is inclined forwardly in the travel direction as indicated by arrow 25. As shown in FIG. 7, the top part 5*a* can be connected with a hinge 34 to the bottom part 5*b* and, thus, the inclination of the top part 5*a* can be adjusted. The manner of operation of the carrier members 5 will be explained in the following in more detail with the aid of FIGS. 3 and 4.

Figure 4:
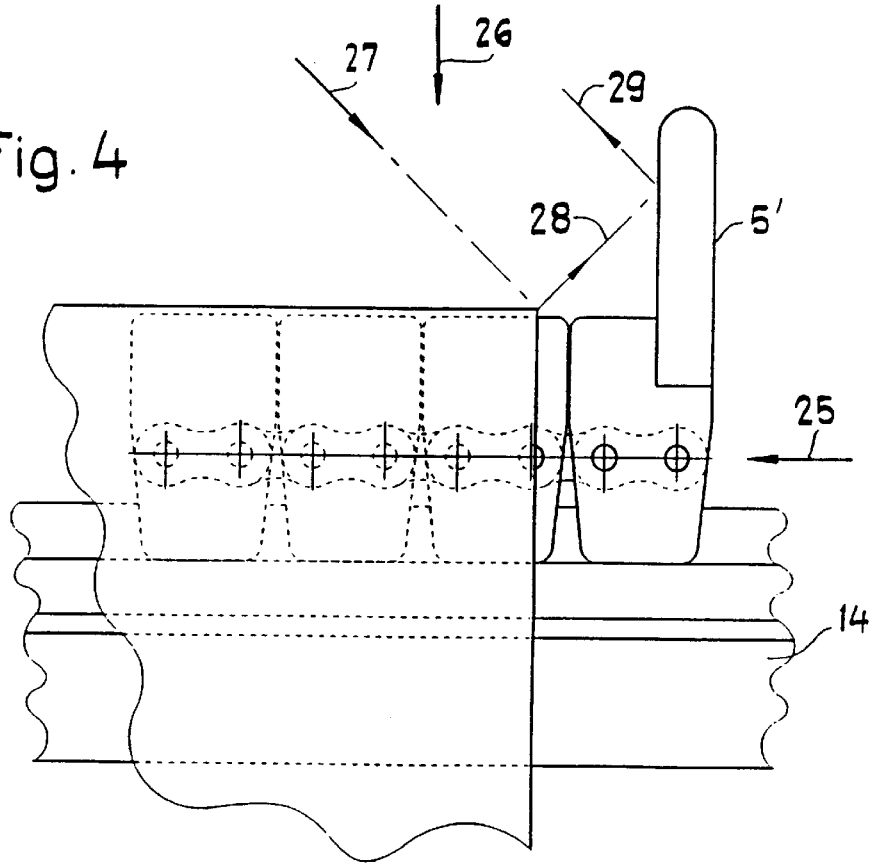
FIG. 4 is a partial view, corresponding to FIG. 3, showing another embodiment of a carrier member.

The collecting chain 2 moves continuously in the direction of arrow 25. A sheet 4 is placed in the direction of arrow 26 vertically onto the collecting chain 2. The relative movement and speed are indicated by arrow 27. When the sheet 4 is placed on the collecting chain 2, it may happen that the sheet 4 is lifted upwardly from the collecting chain in the direction of arrow 28. The rear edge 4*b* makes contact with the carrier member 5. If the carrier member is straight and extends vertically from the collecting chain 2 as shown in FIG. 4, the printed sheet 4 is deflected upwardly and forwardly in the direction of the arrow and may jump from the collecting chain 2. If the carrier member 5 is constructed inclined as shown in FIG. 3, the printed sheet is pushed back downwardly onto the collecting sheet 3 in the direction of arrow 35. Consequently, the printed product 4 is prevented from jumping off. An improvement of this effect can be achieved by a rough surface of the carrier member 5 or by selecting a friction-reducing or damping material, for example, a rough surface or rubber-elastic areas. The printed sheet 4 is placed astride on the collecting chain 2 and is centered on the fold 4*a* by a comb-type member 2*a*. Underneath the collecting chain 2, the printed products 4 are guided by guide plates 13 which, as indicated in FIG. 2 are mounted on a vertically extending support wall 16. This support wall 16 is fastened with screws 17 to a support member 18.

Figure 6:
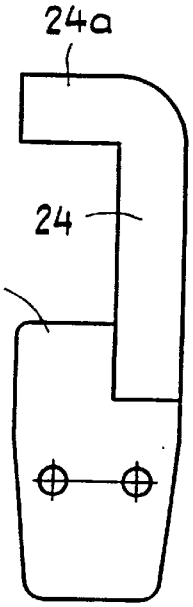
FIGS. 5 and 6 are side views of additional embodiments of the carrier member.
Figure 5:
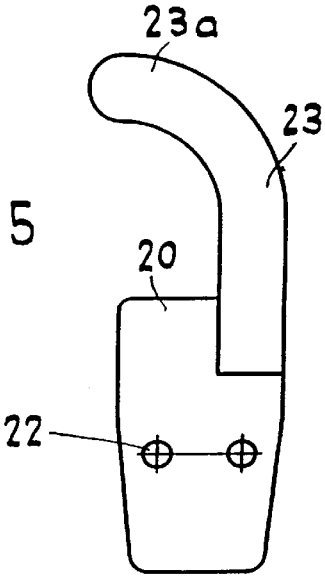

FIGS. 5 and 6 show two additional possible embodiments of carrier members 23 and 24. In both cases, the upper end 23*a* or 24*a* is inclined in the travel direction. However, also conceivable is an embodiment in which the carrier member is elongated as shown in FIG. 4 and, thus, extends exactly vertically upwardly in the active portion 2*a* of the collecting chain 2.

The invention is not limited by the embodiments described above which are presented as examples only but can be modified in various ways within the scope of protection defined by the appended patent claims.

We claim:

1. A conveyor plant for gathering and processing printed sheets, the plant comprising a saddle-shaped collecting chain and a double chain, wherein the collecting chain is constructed to travel between the double chain in a transfer area, further comprising carrier members for the printed sheets mounted one behind the other on the collecting chain, wherein the carrier members are mounted in an upright position on the collecting chain, further comprising carrier members mounted on the double chain, wherein the carrier members of the double chain are mounted with a spacing greater than a spacing of the carrier members of the collecting chain.

2. The plant according to claim 1, wherein the collecting chain has an upper ridge, and wherein the carrier members protrude upwardly above the upper ridge of the collecting chain.

3. The plant according to claim 1, wherein each carrier member has a width and the collecting chain has a width, and wherein the width of the carrier members does not substantially exceed the width of the collecting chain.

4. The plant according to claim 1, wherein the carrier members are inclined forwardly in a travel direction of the collecting chain.

5. The plant according to claim 1, wherein the collecting chain is configured such that the carrier members of the collecting chain are submerged in a gap between the double chain over an area which extends essentially over the transfer area.

6. The plant according to claim 1, wherein the double chain comprises means for driving the collecting chain.

7. The plant according to claim 6, further comprising a chain wheel for guiding a forward end of the collecting chain and a chain wheel for guiding a rearward end of the double chain, further comprising a transmission drive connecting the chain wheels.

8. The plant according to claim 1, wherein the carrier members of the collecting chain are rod-shaped and are directed upwardly at least along an active portion of the collecting chain.

9. The plant according to claim 1, wherein the collecting chain is a link chain having links, further comprising U-shaped elements mounted on the chain links for supporting the printed products.

10. The plant according to claim 9, wherein the links of the link chain are mounted on axle bolts, wherein the U-shaped elements are releasably placed on the chain links, and wherein the U-shaped elements are supported by adjacent axle bolts of the link chain.

11. The plant according to claim 10, wherein the U-shaped elements are placed with locking engagement on the chain links.

* * * * *